US009873595B2

(12) United States Patent
Akin

(10) Patent No.: US 9,873,595 B2
(45) Date of Patent: Jan. 23, 2018

(54) ELEVATOR SILL SYSTEM

(71) Applicant: Scott Akin, Kinnelon, NJ (US)

(72) Inventor: Scott Akin, Kinnelon, NJ (US)

( * ) Notice: Subject to any disclaimer, the term of this patent is extended or adjusted under 35 U.S.C. 154(b) by 114 days.

(21) Appl. No.: 14/549,207

(22) Filed: Nov. 20, 2014

(65) Prior Publication Data

US 2016/0145076 A1 May 26, 2016

(51) Int. Cl.
*B66B 13/30* (2006.01)

(52) U.S. Cl.
CPC ..... *B66B 13/301* (2013.01)

(58) Field of Classification Search
CPC ..... B66B 13/30; B66B 13/301; E04B 1/70; E04B 1/62; E05D 15/06; E06D 9/00
See application file for complete search history.

(56) References Cited

U.S. PATENT DOCUMENTS 1,715,188 A * 5/1929 Bullock ..... B66B 13/301 16/90
1,959,426 A * 5/1934 Henderson ..... H01F 5/02 138/DIG. 4
3,251,382 A * 5/1966 Tatsch ..... F16L 9/003 138/151
3,431,690 A * 3/1969 Halpern ..... E06B 1/70 16/94 R
3,521,404 A * 7/1970 Hager ..... E06B 1/70 49/468
3,584,417 A * 6/1971 Gatton ..... E05D 15/0686 312/116
3,601,938 A * 8/1971 Loomis ..... B66B 13/306 187/408
3,686,808 A * 8/1972 Loomis ..... B66B 13/306 52/211
3,911,554 A * 10/1975 Ford ..... B23C 3/305 228/142
3,984,952 A * 10/1976 Loomis ..... B66B 13/306 33/194
4,079,550 A * 3/1978 Bursk ..... E06B 1/70 428/344
4,402,170 A * 9/1983 Seidner ..... E06B 1/32 52/631
4,704,837 A * 11/1987 Menchetti ..... E04B 2/723 52/273

(Continued)

FOREIGN PATENT DOCUMENTS

JP 05200637 A * 8/1993
JP 08200587 A * 8/1996

(Continued)

OTHER PUBLICATIONS http://americansafetytread.com/cast/elevator-door-sills/; Nov. 10, 2014; website disclosure of American Safety Tread Co., Inc.

*Primary Examiner* — Beth A Stephan
(74) *Attorney, Agent, or Firm* — The McHattie Law Firm, LLC

(57) ABSTRACT

The present invention provides for an elevator sill system, consisting of both a cab sill and a hoistway sill that are comprised of a novel sill foundation and a corresponding and novel sill foundation covering, that when implemented together, provides for an elevator sill system of superior application, performance, durability and appearance at a comparatively low cost to standard and customized elevator sills.

5 Claims, 13 Drawing Sheets

(56) References Cited

U.S. PATENT DOCUMENTS 4,735,293 A * 4/1988 Everhart ..... B66B 13/303 187/318
4,781,270 A * 11/1988 Holland ..... B66B 13/08 187/313
5,165,505 A * 11/1992 Hayashi ..... B66B 13/08 187/333
5,428,929 A * 7/1995 Reese ..... E04F 19/028 52/255
5,469,666 A * 11/1995 Lewis, Jr. ..... E06B 3/4636 49/467
5,479,754 A * 1/1996 Pelvilain ..... B66B 13/303 187/408
5,609,224 A 3/1997 Baggot
5,611,173 A * 3/1997 Headrick ..... E06B 1/70 118/504
5,671,967 A * 9/1997 Gurganus ..... B60R 13/0206 296/146.9
5,673,770 A * 10/1997 Friedman ..... B66B 13/08 187/333
5,715,913 A 2/1998 De Jong
5,794,746 A * 8/1998 Ketonen ..... B66B 13/301 187/333
5,915,501 A * 6/1999 Lodi ..... B66B 13/301 187/333
5,918,644 A * 7/1999 Haack ..... F16L 9/003 138/146
5,988,321 A * 11/1999 Kondo ..... B66B 13/303 187/333
6,044,600 A * 4/2000 McCollough ..... E06B 1/70 52/209
6,216,395 B1 * 4/2001 Kelly ..... E04G 21/30 49/467
6,216,396 B1 * 4/2001 Katz ..... A47B 35/00 52/2.11
6,269,591 B1 * 8/2001 Kelly ..... E06B 1/70 49/482.1
6,357,187 B1 * 3/2002 Haldeman ..... E06B 3/88 49/462
6,526,708 B1 * 3/2003 Hartley ..... E06B 1/34 248/345.1
6,684,573 B2 2/2004 Heath
6,703,102 B1 * 3/2004 Prescott ..... E04G 21/30 428/76
6,718,706 B2 * 4/2004 Katz ..... E06B 3/88 52/211
6,789,358 B2 * 9/2004 Procton ..... E06B 1/6092 49/467
6,829,864 B2 * 12/2004 Mitchell ..... E06B 1/70 52/204.5
6,938,380 B2 9/2005 Friedman
7,712,787 B2 * 5/2010 Vincenti ..... F16B 15/0046 285/257
7,788,854 B2 9/2010 Friedman
8,707,640 B2 * 4/2014 Wright ..... E04F 17/04 52/220.5
8,857,107 B1 * 10/2014 Key ..... E06B 1/70 49/460
8,991,100 B2 * 3/2015 Van Camp ..... E06B 1/70 49/303
2003/0126826 A1 * 7/2003 Marshall ..... E06B 1/70 52/718.01
2004/0206581 A1 * 10/2004 Baumann ..... B66B 13/301 187/313
2006/0005470 A1 * 1/2006 Mullen ..... E06B 1/70 49/467
2006/0053713 A1 * 3/2006 Remin ..... E04B 9/00 52/287.1
2006/0123720 A1 * 6/2006 Liu ..... E06B 1/06 52/211
2007/0039257 A1 * 2/2007 LeBlanc ..... E04D 13/15 52/211
2007/0227076 A1 * 10/2007 Braun ..... E06B 7/14 49/505
2008/0256881 A1 * 10/2008 Lowry ..... E06B 3/88 52/212
2010/0024327 A1 * 2/2010 Kennedy ..... B29C 53/063 52/182
2013/0081339 A1 * 4/2013 Kreyling ..... A47G 27/0212 52/177
2013/0091776 A1 * 4/2013 Van Camp ..... E06B 1/70 49/467
2014/0290836 A1 * 10/2014 Lanciaux ..... B29D 23/001 156/217
2014/0310912 A1 * 10/2014 Pardoe ..... E06B 1/347 16/82
2014/0318021 A1 * 10/2014 Van Camp ..... E06B 1/70 49/469

FOREIGN PATENT DOCUMENTS

JP 2004132736 A * 4/2004
JP 2013245038 A * 12/2013
KR 101055745 B1 * 8/2011
WO WO 2008105871 A1 * 9/2008 ..... B66B 13/301
WO WO 2010083002 A2 * 7/2010 ..... B66B 13/301

* cited by examiner

ELEVATOR SILL SYSTEM

FIELD OF THE INVENTION

The present invention provides for an elevator sill system, consisting of both a cab sill and a hoistway sill that are comprised of a novel sill foundation and a corresponding and novel sill foundation covering, that when implemented together, provides for an elevator sill system of superior application, performance, durability and appearance at a comparatively low cost to standard and customized elevator sills.

The elevator sill system of the present invention may be comprised of: (a) an existing elevator sill foundation and a sill foundation covering adapted to fit said existing sill foundation; or (b) a newly fabricated paired sill foundation and sill foundation covering; or (c) a sill foundation specially adapted to receive a sill foundation covering that, when united together, provides such superior application, performance, durability and appearance at a comparatively low cost to standard and customized elevator sills. Importantly, the final product, when installed, must maintain the functionality of the existing elevator door system. With this invention, the sometimes arduous and costly task of replacing existing elevator sills is simplified and enhanced with a more durable and/or attractive sill. In some cases, what might be too expensive (and not get done), actually now gets done, which enhances safety. Notably, the existing elevator sill system does not have to be removed to accept the new sill foundation covering, as it can be implemented by adding as little as approximately ⅛" of added thickness, which variance is generally within elevator door system's adjustment capabilities. Alternatively, and significantly easier than replacing an elevator sill system, the existing sill foundation can be adjusted in place to accept the sill foundation covering of the present invention and resultantly come within the elevator door system's adjustment capabilities. The combined sill foundation (whether it is an existing sill foundation or a newly fabricated sill foundation) and sill foundation covering will provide for ease of installation, superior performance, durability, safety and appearance at a comparatively low cost when compared to standard or customized elevator sills or the replacement of an existing elevator sill system.

BACKGROUND

In operation, when an elevator cab stops at a certain floor, the interior door of the elevator cab ("cab door") and exterior door of the floor ("hoistway door") must meet and slide open and closed uniformly. To accomplish this, the doors slide along a bottom sill that has horizontal grooves to guide the door movement. There is a portion of the sill that is constructed in the cab ("cab sill") and a portion of the sill that is constructed on the floor where the cab stops ("hoistway sill.") Jointly, the cab sill and hoistway sill are known as an "elevator sill system." When the cab stops at a given floor, the cab sill and the hoistway sill align allowing for uniformity in the opening and closing of the cab and hoistway doors.

Cab and hoistway sills are utilized in elevator systems that have sliding doors. Both sills are comprised of a sill foundation material with a sill surface material. Cab and hoistway sills have horizontal grooves. A set of door gibs (guides) attach to the bottom of a cab door and/or hoistway door and travels in the horizontal grooves of a cab and/or hoistway sill. This configuration allows the corresponding cab door and hoistway door to open and close uniformly. The cab and hoistway sill materials typically undergo significant wear and tear, as well as stress from the continual opening and closing of the cab and/or hoistway doors and foot traffic. In addition, cab and hoistway sills must be fireproof, fire resistant and/or fire rated to ensure that during a fire emergency, smoke and fire stay contained to the affected floor of a multistory building. Sill materials must be able to withstand fire and smoke stresses and create an acceptable barrier over an acceptable time frame.

Typically, existing elevator sill systems comprise a unified sill foundation material and a sill surface material, i.e., they are one continuous material fabricated as one piece. As such, cab and hoistway sills are constructed from durable and fireproof materials, typically, cast or extruded aluminum, bronze, iron, stainless steel or nickel silver. Softer materials, such as aluminum, or plastics and other manufactured materials such as PVC, acrylic, polycarbonate, ABS, polystyrene, epoxy, resin, epoxy resin and the like are easier, faster and less expensive to manufacture, but wear much faster. These softer materials can also provide for fireproofing. On the other hand, harder and more durable materials, such as cast or extruded bronze, iron, stainless steel, or nickel silver and other architecturally desirable metals, are difficult and more expensive to manufacture, but when made and installed properly, last longer and remain cosmetically more attractive. Extruded stainless steel and other materials have the additional limitation in that the extrusion process does not provide for sharp edges and angles, i.e., what is required to produce cosmetically and/or architecturally desirable visible surfaces and/or treads. This limitation is present in other extruded metals, thus making extruded elevator sill systems aesthetically and architecturally disfavored. Due to this limitation, aesthetically desirable cab and hoistway sills are fabricated from several different non-extruded sections that must be welded together—an expensive and time consuming process.

In many circumstances and for a variety of reasons, including but not limited to brand competition and varying architectural limitations, there are no standard unified dimensions of a cab and/or hoistway sill. This substantially raises the costs and time necessary for construction of cab and hoistway sills.

Recently, there have been attempts at improving currently available elevator sills and hoistway sills. For example, American Safety Tread Co., Inc. has developed a cast anti slip protection sill. They manufacture an "'alumacast'—corrosion resistant, maintenance free aluminum alloy all-purpose usage; 'feracast'—cast iron all-purpose usage. Will withstand heavy industrial punishment. Ships with one coat of shop applied black paint; "bronzacast/nickelcast'—natural bronze finish makes this an ideal choice for an upscale, classic effect." See www.americansafetytread.com/cast/elevator-door-sills/.

In another example, U.S. Pat. No. 5,609,224 titled, "ELEVATOR DOOR SILL" issued Mar. 11, 1997 discloses, "an elevator cab (10) with a door sill (28) adjacent to the landing sill (40) with a gap (44) there between and door sill and/or landing sill configured to produce a visual effect of enlarging the visual appearance of the gap."

In another example, U.S. Pat. No. 5,715,913 titled, "DOOR SILL FOR AN ELEVATOR CAR" issued Feb. 10, 1998 discloses a "sill system for an elevator car, comprising a sill profile (5), a lower door guide (7) movable in a slot (12) in the sill profile (5) and a guide holding bracket (9) for connecting the lower door guide (7) to the door. The guide holding bracket (9) is passed to the lower door guide (7) from below the surface level of the car floor (3)."

In another example, U.S. Pat. No. 6,684,573 titled, "ELEVATOR DOOR SILL ASSEMBLY" issued Feb. 3, 2004 discloses an "elevator door sill assembly for use in elevator systems that have sliding doors. The door sill assembly comprises a sill plate, a support sill located below the sill plate having a rail that presents an inboard sliding surface and an outboard sliding surface. The assembly also comprises a first guiding surface that engages that inboard sliding surface and a second guiding surface that engages the outboard sliding surface. The assembly prevents that bottom of the elevator door from swinging while the door slides opened and closed. The sill assembly and guide system may be used with either hoistway doors or elevator car doors."

In another example, U.S. Pat. No. 6,938,380 titled, "ELEVATOR ENTRANCE SILL STRUCTURE AND INSTALLATION METHOD" issued Sep. 6, 2005 discloses an invention that "related to a cost saving way of solving a difficult problem in the structure and installation and leveling of an elevator sill. This invention provides ease of installing from the hallway without the use of a moving elevator platform. The structure consists of a sill, a cradle for the sill and a pair of end brackets for supporting the cradle. The pair of spaced L-shaped end brackets are provided for attachment to the hall floor. A vertically adjustable sill is mounted on the sill cradle. The elevator door sill cradle is adjustable vertically by means of fasteners that are moveable in vertical slots in the end brackets and is horizontally adjustable on the cradle by means of fasteners that are moveable in horizontal slots provided in the cradle."

In another example, Application No. PCT/US2009/068633 discloses, "an exemplary sill for use in an elevator system includes a sill plate that is a single piece of metal. The sill plate has a first portion in a first plane and a second portion adjacent to the first portion. The second portion is bent into a second plane that intersects the first plane. A third portion is adjacent to the second portion. The third portion is bent at least partially into a third plane that intersects the second plane. A fourth portion is adjacent to the third portion. The fourth portion is bent into a fourth plane that intersects the third plane and intersects the first plane. A fifth portion is adjacent to the fourth portion. The fifth portion is bent into the first plane. The second, third and fourth portions collectively establish a groove that is configured to receive a portion of an elevator system door. A base portion is provided in a plane parallel to the first plane. Connector portions near opposite ends of the base portion protrude from the base portion in a direction toward the first plane of the sill plate. At least one of the connector portions is connected to a selected portion of the sill plate near an end of the sill plate."

There is no currently disclosed cab and/or hoistway sill or elevator sill system that combines the low cost and ease of manufacturing of sills comprised of inexpensive materials and the high durability, fire rating and attractive finish of expensive custom fabricated architecturally desirable nonferrous materials such as bronze, stainless steel, nickel silver or other architecturally desirable ferrous materials. Objectives of the present invention include providing a low cost, easy to manufacture, durable, fire rated, attractive and fully customizable cab and/or hoistway sill that includes sharp, architecturally and aesthetically desirable angled, non-rounded edges. All known elevator cab and hoistway sills sacrifice one or more of the foregoing attributes. The present invention provides a solution to the unmet need by providing cab and hoistway sills that are economical to manufacture that are also highly durable, fire rated, possesses an architecturally attractive and safety conscious finish consisting of architecturally and aesthetically desirable materials and custom designed surface finishes, as well as sharp, angled non-rounded edges.

The present invention also allows for existing elevator sill systems to be upgraded by cladding with sill foundation coverings consisting of architecturally and aesthetically desirable materials, thus eliminating the costly and destructive exercise of removing and replacing preexisting cab and hoistway sills when a new sill is needed or desired.

None of the foregoing references, alone or in combination, teach the salient and essential features of the instant invention. There remains, therefore an unmet need for a device that provides all of the attributes of a low cost, economical to manufacture, durable, fire rated, attractive and fully customizable cab sill and hoistway sill.

SUMMARY

In one embodiment, the device of the present invention comprises a sill foundation and a corresponding sill foundation covering, that when implemented together, provides for an elevator sill of superior performance, durability, fire rating, and appearance at a comparatively low cost to standard and customized elevator sills. The sill foundation covering provides an economical to manufacture cladding to cover the sill foundation in a custom configuration wherein the sill foundation covering is comprised of durable and aesthetically pleasing materials such as architectural metals or other aesthetically desirable materials.

In one embodiment, the device of the present invention comprises a sill foundation covering made of a durable and aesthetically pleasing material such as an architectural metal, that matches existing and currently installed cab and/or hoistway sills dimensionally such that when covering the existing sill, the now covered sill is a functional reproduction, within variable tolerances of the original sill in orientation and configuration of grooves and is therefore capable of implementation into the existing elevator cab and hoistway door assemblies.

In one embodiment, the sill foundation covering could be fashioned from any suitable material desirable for an elevator sill system. For example, any architecturally desirable nonferrous material can be used such as bronze, stainless steel, nickel silver and the like. In addition, other architecturally desirable ferrous materials or other as yet undeveloped materials can also be utilized.

In one embodiment, the surface of the sill foundation covering may be brushed or finished with anti-slip coatings and/or metallic finishes for functional and/or cosmetic purposes.

In one embodiment, the sill foundation covering is fashioned by bending a sheet of bronze, nickel, nickel-steel, nickel-silver, iron, stainless steel and the like, into the proper configuration via a proprietary process of "v-grooving" wherein a groove is first cut in the sheet via a custom v-groove machine to create "v-channels" where the bends in the sheet will occur to create sharp, angled, non-rounded edges.

In one embodiment, the sharp, angled, non-rounded edges are approximately ninety degree angles.

In one embodiment, the sharp, angled, non-rounded edges are any architecturally desired angle based on the configuration of the grooves required in the sill system to impart functionality and/or pleasing aesthetics and/or safety features.

In one embodiment, any suitable sturdy underlying material can be used to create a cab and/or hoistway sill foundation upon which the sill foundation covering can be added. For example, PVC, acrylic, polycarbonate, ABS, polystyrene, epoxy, resin, epoxy resin, plastic and the like could be used to create a cab and/or hoistway sill foundation to accept the sill foundation covering so long as the material can support the required weight load, endure the daily stresses and embody the appropriate fire rating.

In one embodiment, any fireproof sturdy underlying material that can support the required weight load could be used to create a cab and/or hoistway sill foundation upon which the sill covering can be added. For example, a fireproof and/or fire resistant resin or epoxy resin such as VIPEL™ K010-TB, FIREPEL™ K130 or FIREPEL™ K133 could be utilized to create a cab and/or hoistway sill foundation to accept the sill foundation covering.

In one embodiment, the sill foundation covering may be adhered to any sill foundation through the use of bonding adhesives, cement, glue or permanent tape.

In one embodiment, the sill foundation covering may be adhered to a new sill foundation through the use of bonding adhesives, cement, glue or permanent tape.

In one embodiment, the sill foundation covering may be adhered to an existing elevator sill system, that in this situation becomes the sill foundation, through the use of bonding adhesives, cement, glue or permanent tape.

In one embodiment, the sill foundation covering may be adhered to any sill foundation through the use of any known metal fastening mechanism, such as screws, rivets, welds, solder and the like.

In one embodiment, the sill foundation covering may be adhered to a new sill foundation through the use of any known metal fastening mechanism, such as screws, rivets, welds, solder and the like.

In one embodiment, the sill foundation covering may be adhered to an existing elevator sill system, that in this case becomes the sill foundation, through the use of any known metal fastening mechanism, such as screws, rivets, welds, solder and the like.

In one embodiment, the sill foundation covering may be adhered to any sill foundation through the use of any known metal fastening mechanism, such as screws, rivets, welds, solder and the like and/or in combination with bonding adhesives, cement, glue or permanent tape.

In one embodiment, the sill foundation covering may be adhered to a new sill foundation through the use of any known metal fastening mechanism, such as screws, rivets, welds, solder and the like and/or in combination with bonding adhesives, cement, glue or permanent tape.

In one embodiment, the sill foundation covering may be adhered to an existing elevator sill system, that in this case becomes the sill foundation, through the use of any known metal fastening mechanism, such as screws, rivets, welds, solder and the like and/or in combination with bonding adhesives, cement, glue or permanent tape.

In one embodiment, a typical permanent tape bonding may be implemented to bond the sill foundation covering with an existing or new cab and/or hoistway sill or sill foundation such as disclosed by 3M™ VHB™ permanent assembly tapes.

Because the underlying new cab and/or hoistway sill foundation or existing elevator sill system is typically made of metal or other flat surface, it provides a sturdy surface with an appropriate fire rating to adhere the sill foundation covering to provide an outer surface resistant to normal wear and tear. Although, the underlying cab and hoistway sill or sill foundation may be made of PVC, acrylic, polycarbonate, ABS, polystyrene, epoxy, resin, epoxy resin, plastic or most metals, they all provide sturdy surface for bonding with an acrylic foam tape to provide the attachment of an outer surface, such as the sill foundation covering, resistant to normal wear and tear.

In one embodiment, a cab and/or hoistway sill foundation made from PVC, acrylic, polycarbonate, ABS, polystyrene, epoxy, resin, epoxy resin, plastic and the like may be reinforced for added strength or contain a fire retardant layer for added fire rating. In this manner, it becomes economical to manufacture and form any shape, dimension and configuration of cab and/or hoistway sill foundation in a rapid manner. Once the sill foundation of the present invention is adhered with the sill foundation covering of the present invention, strength and stability will be enhanced and the wear and durability properties of the outer surface will maintain the same inherent properties as if the entire cab and hoistway sills were comprised exclusively of architecturally and/or aesthetically desirable materials such as architectural metals.

DETAILED DESCRIPTION

Figure 1:
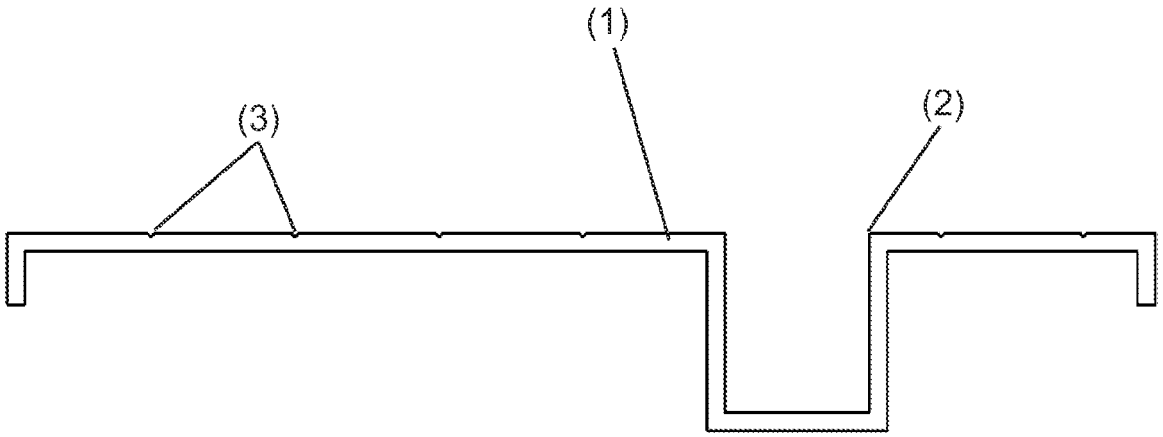
FIG. 1 depicts a view of one embodiment of the sill foundation covering (1) of the elevator sill system of the present invention comprising sharp, angled non-rounded edges (2) and tread grooves (3).
Figure 2:
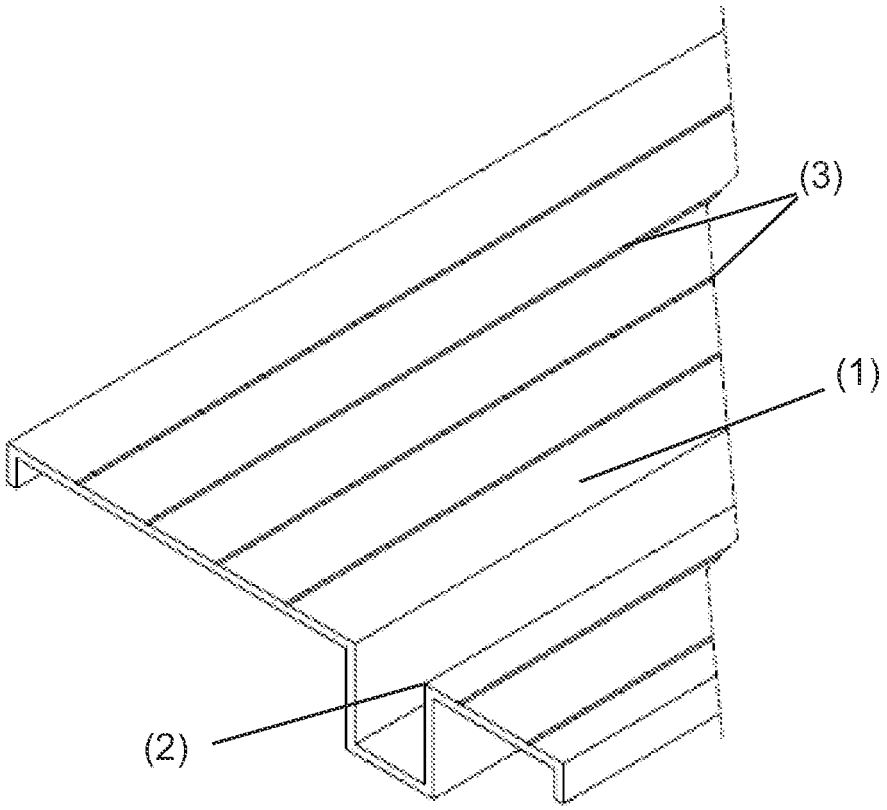
FIG. 2 depicts an alternate view of one embodiment of the sill foundation covering (1) of the elevator sill system of the present invention comprising sharp, angled non-rounded edges (2) and tread grooves (3).
Figure 3:
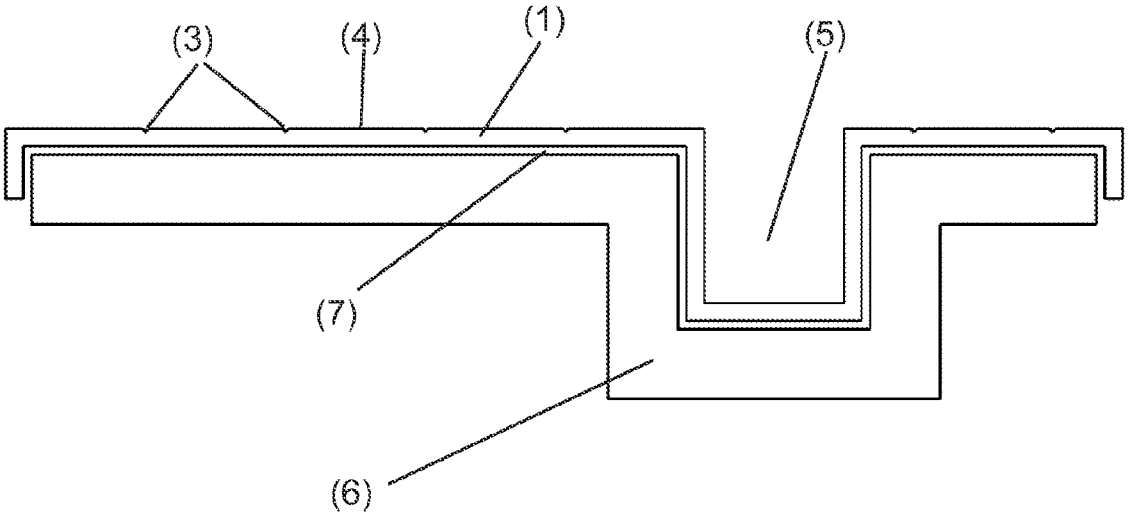
FIG. 3 depicts a view of one embodiment of the present invention showing the sill foundation covering (1) with custom designed outer finish (4) showing tread grooves (3) and horizontal grooves in which a cab door and/or hoistway door gib will travel (5) and adhered to a sill foundation (6) via a permanent bonding tape (7).
Figure 4:
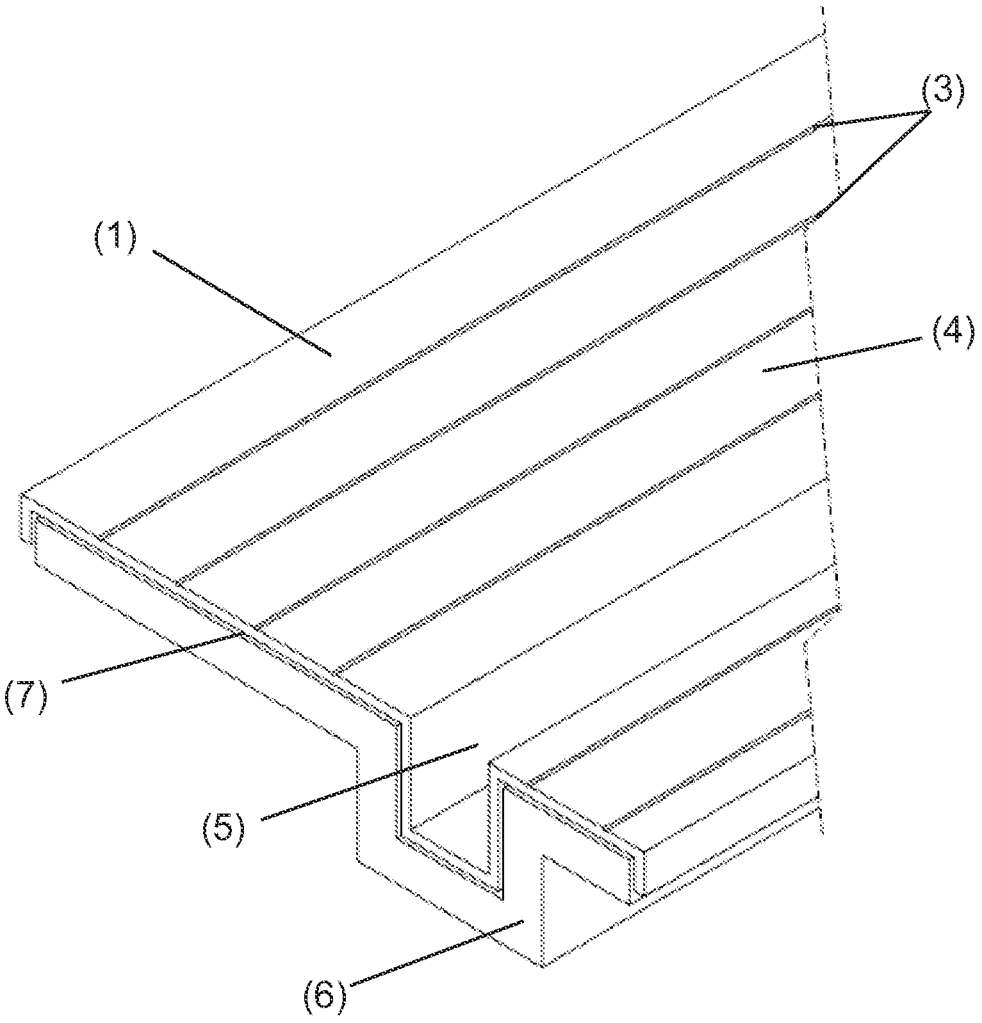
FIG. 4 depicts an alternate view of one embodiment of the present invention showing the sill foundation covering (1) with custom designed outer surface finish (4) showing tread grooves (3) and horizontal grooves in which a cab door and/or hoistway door gib will travel (5) and adhered to a sill foundation (6) via a permanent bonding tape (7).
Figure 5:
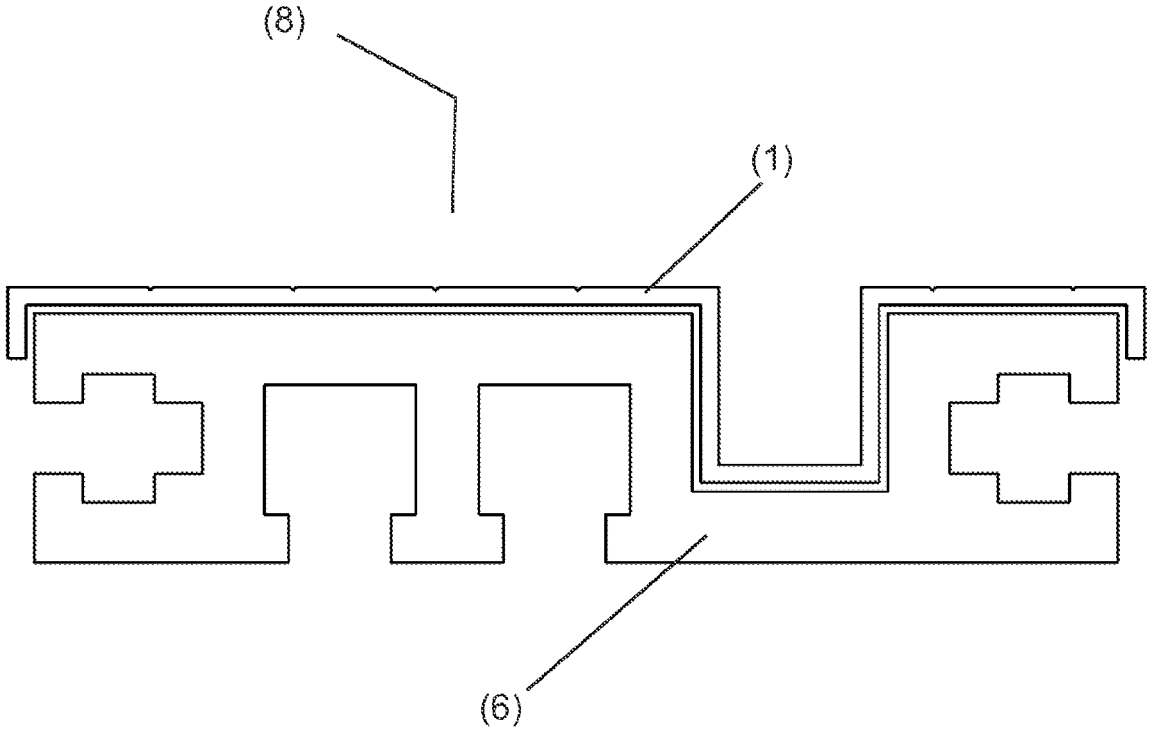
FIG. 5 depicts a view of one embodiment of the elevator sill system of the present invention (8) showing an alternate configuration of a sill foundation (6) and a corresponding sill foundation covering (1).
Figure 6:
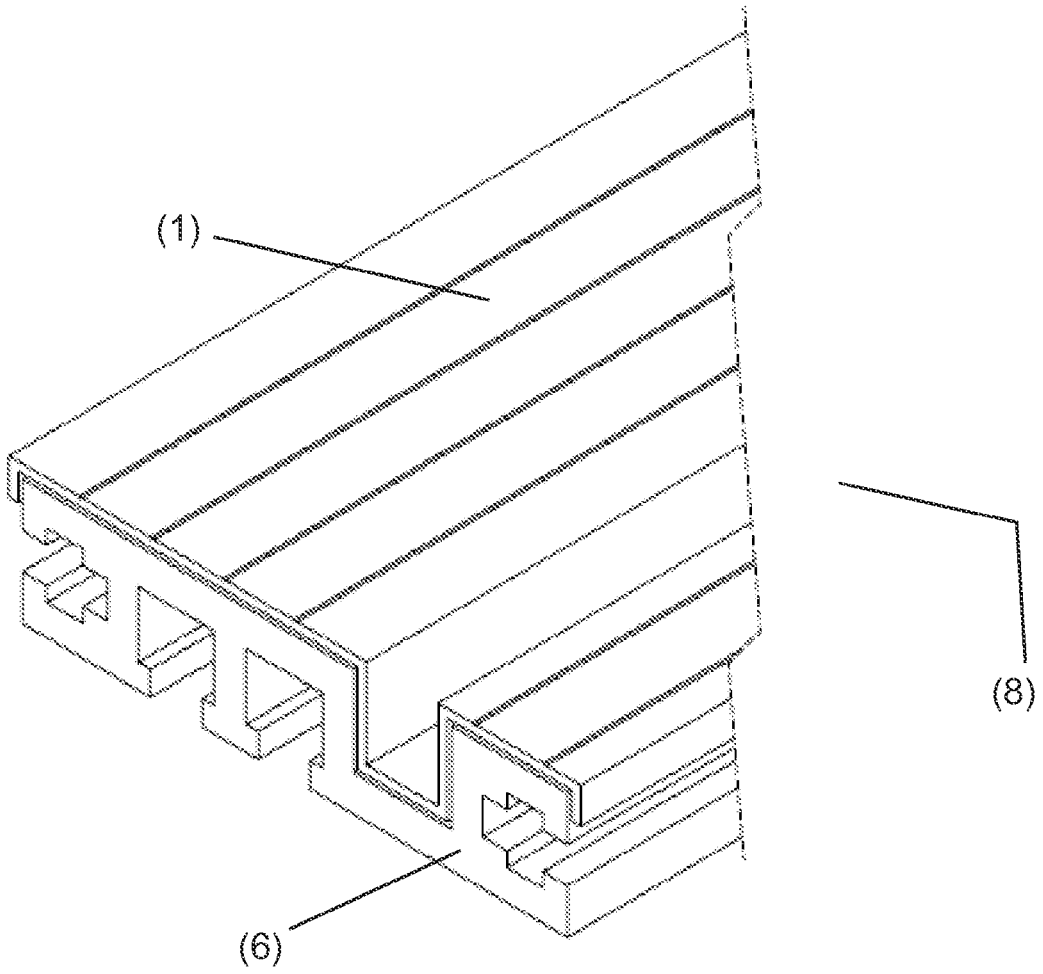
FIG. 6 depicts a view of an alternate view of the elevator sill system of the present invention (8) showing an alternate configuration of a sill foundation (6) and a corresponding sill foundation covering (1).
Figure 7:
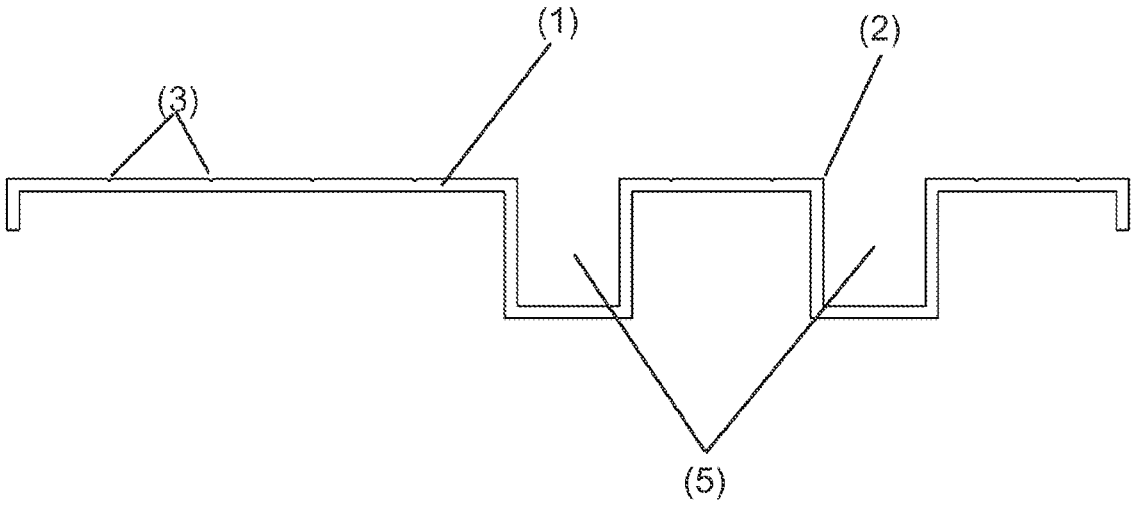
FIG. 7 depicts a view of one embodiment of the present invention showing an alternate configuration of the sill foundation covering (1) of the elevator sill system of the present invention comprising sharp, angled non-rounded edges (2) and tread grooves (3) and dual horizontal grooves in which a cab door and/or hoistway door gib will travel (5).
Figure 8:
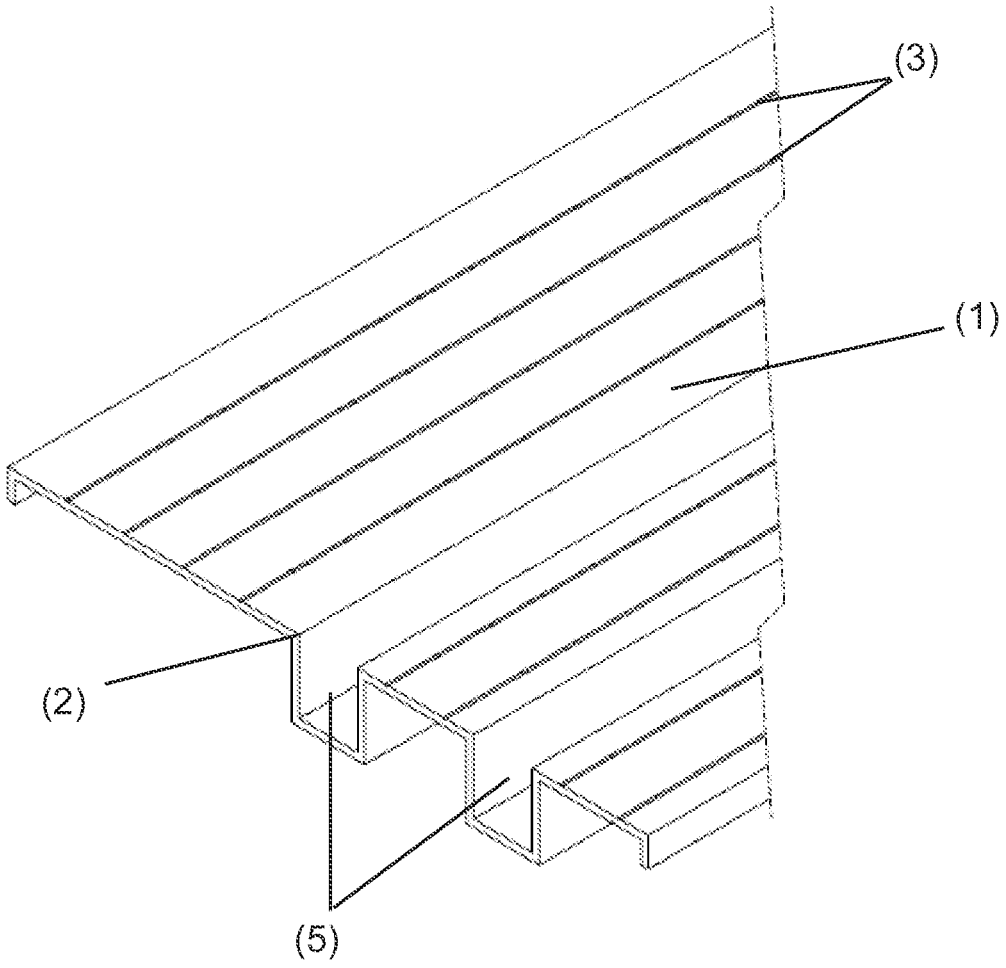
FIG. 8 depicts an alternate view of one embodiment of the present invention showing an alternate configuration of the sill foundation covering (1) of the elevator sill system of the present invention comprising sharp, angled non-rounded edges (2) and tread grooves (3) and dual horizontal grooves in which a cab door and/or hoistway door gib will travel (5).
Figure 9:
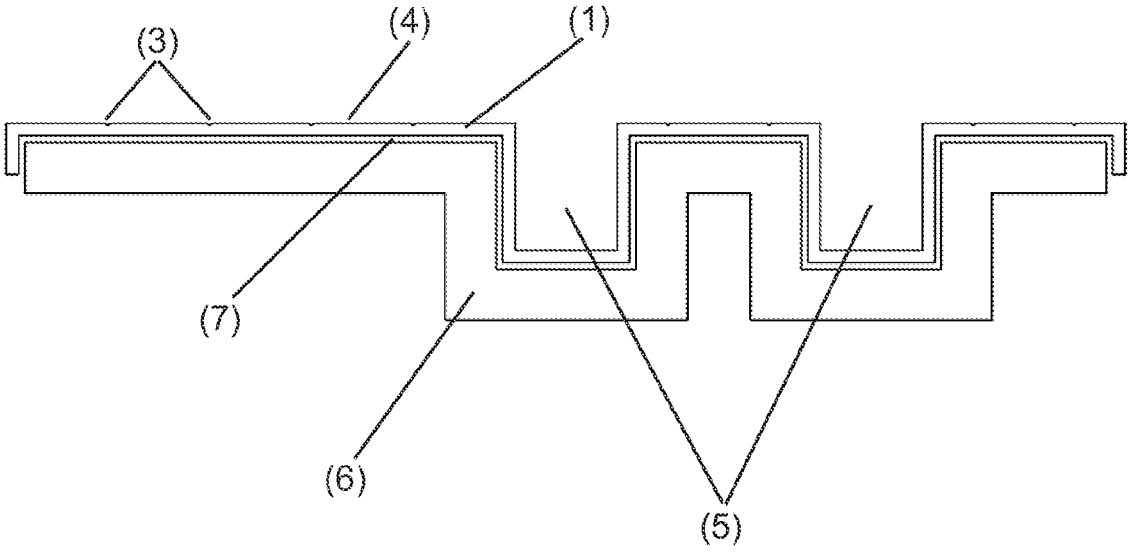
FIG. 9 depicts a view of one embodiment of the present invention showing an alternate configuration of the sill foundation covering (1) with custom designed outer surface finish (4) showing tread grooves (3) and horizontal grooves in which a cab door and/or hoistway door gib will travel (5) and adhered to a sill foundation (6) via a permanent bonding tape (7).
Figure 10:
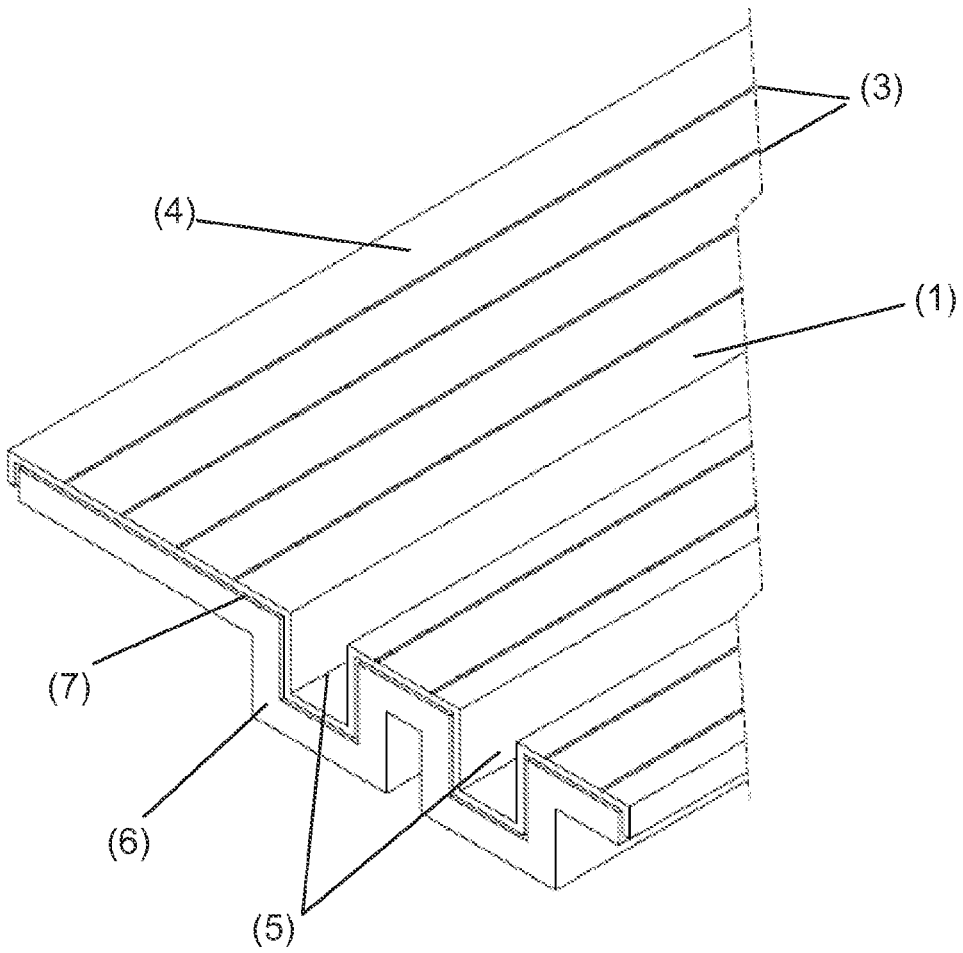
FIG. 10 depicts an alternate view of one embodiment of the present invention showing an alternate configuration of the sill foundation covering (1) with custom designed outer surface finish (4) showing tread grooves (3) and horizontal grooves in which a cab door and/or hoistway door gib will travel (5) and adhered to a sill foundation (6) via a permanent bonding tape (7).
Figure 11:
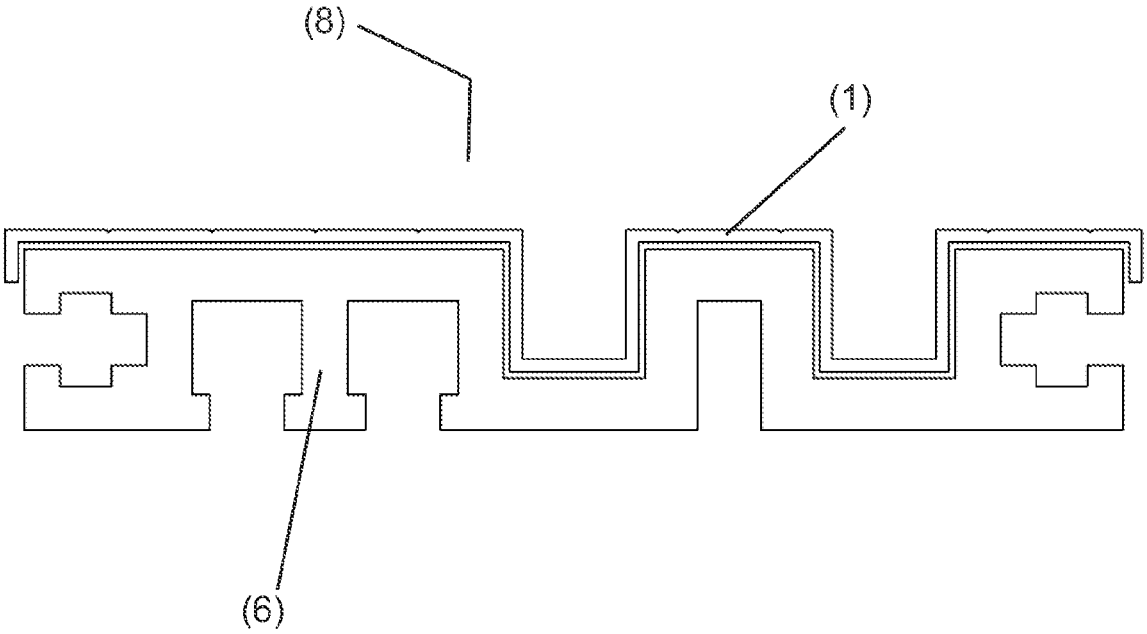
FIG. 11 depicts a view of one embodiment of the elevator sill system of the present invention (8) showing an alternate configuration of a sill foundation (6) and a corresponding sill foundation covering (1).
Figure 12:
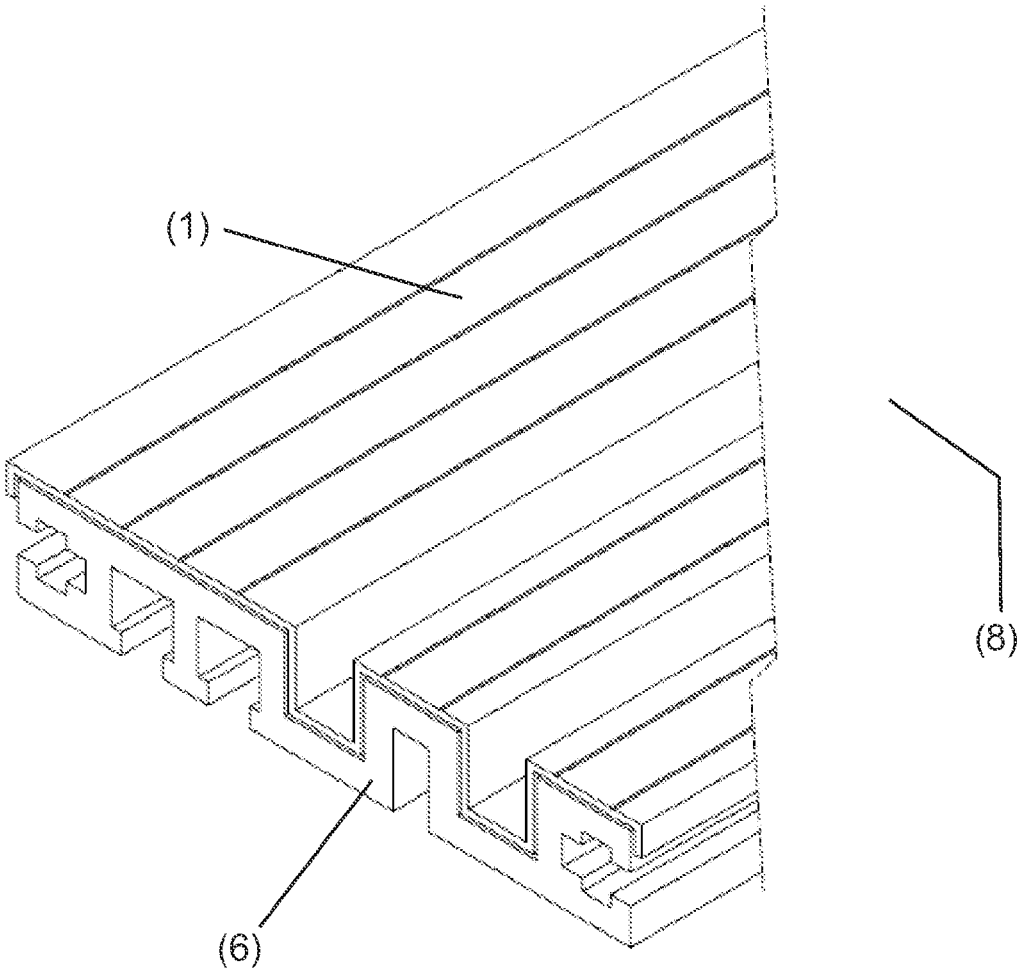
FIG. 12 depicts an alternate view of one embodiment of the elevator sill system of the present invention (8) showing an alternate configuration of a sill foundation (6) and a corresponding sill foundation covering (1).
Figure 13:
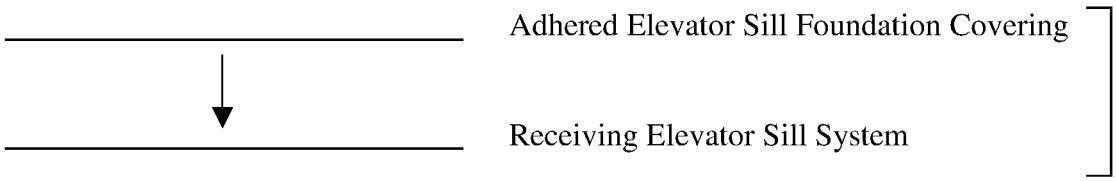
FIG. 13 is an exploded, diagrammatic view illustrating the adhesion of an adhered elevator sill foundation covering to a receiving elevator sill system.

For clarity of disclosure, and not by way of limitation, the detailed description of the invention is divided into the following subsections that describe or illustrate certain features, embodiments or applications of the present invention

Definitions

"Cab sill" as used herein refers to the bottom horizontal member of an elevator cab assembly across which the elevator cab door is guided through opening and closing. A corresponding hoistway sill exists at every floor where the elevator stops.

"Hoistway sill" as used herein refers to the bottom horizontal member of an elevator floor entry assembly across which the outer elevator door or hoistway door is guided through opening and closing. A corresponding cab sill exists within the elevator cab assembly that stops at the floor.

"Sill surface" as used herein refers to the upward horizontal facing surface of a cab and/or hoistway sill as defined herein.

"Sill foundation covering" as used herein refers to a component of a cab and/or hoistway sill that is capable of affixing atop a sill foundation and comprises the sill surface.

"Silt foundation" as used herein refers to a component of a cab sill and/or hoistway sill that is below the sill surface of the cab sill and/or hoistway sill and forms a suitable base material for supporting a sill foundation covering comprising the sill surface. At times, the sill foundation and sill foundation covering may be constructed of one continuous material and at times may be constructed separately and adhered together. At times, an existing cab sill, hoistway sill or elevator sill system may form a sill foundation in an alternative sill construction.

"Elevator sill system" as used herein refers to both the cab sill and hoistway sill as they are defined herein and function together within an elevator door system.

"Elevator door system" as used herein refers to the entire mechanism by which the operation of both an elevator's cab and hoistway doors is achieved.

The Device of the Present Invention

In one embodiment, the device of the present invention comprises low cost high durability cab and hoistway sills comprised of individual sill foundations, constructed of a low-cost foundation such as PVC, acrylic, polycarbonate, ABS, polystyrene, epoxy, resin, epoxy resin, plastic or most metals, that are clad in and/or otherwise attached to a sill foundation covering comprised of a more expensive, durable and aesthetically pleasing and desirable materials such as architectural metals.

In one embodiment, the sill foundation covering may be adhered to an existing elevator sill system serving as the sill foundation or a new cab and/or hoistway sill foundation through the use of bonding adhesives, cement, glue or permanent tape.

In one embodiment, the sill foundation covering may be adhered to an existing elevator sill system or a new cab and/or hoistway sill foundation through the use of any known metal fastening mechanism, such as screws, rivets, solder, welds or the like.

In one embodiment, the sill foundation covering may be adhered to an existing elevator sill system or a new cab and/or hoistway sill foundation through the use of any known metal fastening mechanism, such as screws, rivets, welds, solder and the like and/or in combination with bonding adhesives, cement, glue or permanent tape.

In one embodiment, the device of the present invention comprises a sill foundation covering made of durable and aesthetically pleasing architecturally desirable metals such as bronze, nickel, nickel-steel, nickel-silver, iron, stainless steel and the like that conforms to an existing and currently installed elevator sill system dimensionally such that when covering the existing elevator sill system, the now covered elevator sill system maintains the functionality of the existing elevator door system.

In one embodiment, the sill foundation covering is fashioned from architectural metals such as bronze, nickel, stainless steel, steel and/or nickel silver.

In one embodiment, the sill foundation covering is fashioned by bending sheets of bronze, nickel, nickel-steel, nickel-silver, iron, stainless steel and the like, into the proper configuration by a proprietary process of "v-grooving" wherein a groove is first cut in the sheet via a custom v-groove type router to create "v-channels" where the bends in the sheet will occur, to create the sharp, angled, non-rounded edges which may be ninety-degree angles or some other angle that is architecturally required or desired in a given application.

In one embodiment, any suitable sturdy underlying material for a cab and/or hoistway sill foundation would work. For example PVC, acrylic, polycarbonate, ABS, polystyrene, epoxy, resin, epoxy resin, plastic and the like could be used to create the cab and/or hoistway sill foundation that will accept the sill foundation covering so long as the material can support the required weight load, endure the daily stresses and is appropriately fire rated when implemented as taught herein. The PVC, acrylic, polycarbonate, ABS, polystyrene, epoxy, resin, epoxy resin, plastic and the like may be reinforced fir added strength. In this manner, it becomes economical to firm any shape, dimension and configuration of cab and/or hoistway sill foundation and otherwise provide for rapid manufacturing. Once the sill foundation of the present invention is adhered to the sill foundation covering of the present invention, the strength and stability of the elevator sill system will be enhanced and the wear and durability properties of the outer surfaces of the elevator sill system will maintain the same inherent properties as if the elevator sill system was comprised exclusively of architectural metals or other more expensive materials.

In one embodiment, if the cab and/or hoistway sill is required to be fireproof and/or fire resistant, fireproof and/or fire resistant resins and/or epoxy resins such as VIPEL™ K010-TB, FIREPEL™ K130 or FIREPEL™ K133 or the like could be utilized to create a cab and/or hoistway sill foundation to accept the sill foundation covering.

In one embodiment, if cab and/or hoistway sill is required to be fireproof and/or fire resistant, any available fire proof and/or fire resistant material could be utilized to create a cab and/or hoistway sill foundation to accept the sill foundation covering.

In one embodiment, the sill foundation covering could be fashioned from any suitable material desirable for the outer surface of an elevator sill system. For example, nonferrous metals such as bronze, nickel-silver, stainless steel as well as ferrous materials such cold rolled steel, galvanized steel and the like may be used.

In one embodiment, the cab and/or hoistway sill foundations could be fashioned out of any suitable material that can withstand the load requirements of an elevator sill system.

In one embodiment, any of the foregoing surfaces of the sill foundation covering may be brushed or finished with anti-slip coatings, metallic finishes or the like for functional and/or cosmetic purposes.

EXAMPLES

The present invention is further illustrated, but not limited by, the following examples.

In one embodiment, someone desires to replace an existing elevator sill system. Typically, to replace an elevator sill system, that person must purchase a costly new elevator sill system. In addition, they must undertake the labor intensive, destructive and expensive process of removing the existing elevator sill system. The removal of an existing elevator sill system is especially difficult and costly if the existing elevator sill system is installed in custom flooring or flooring that is no longer commercially available. The present invention solves the aforesaid inherent problems associated with the replacement of existing elevator sill systems. Through the use of the present invention, the person desirous of replacing the existing elevator sill system no longer must remove it to replace it. Instead, the existing elevator sill system is field measured and a custom made sill foundation covering constructed from architecturally and/or aesthetically desirable materials specified is manufactured. An installer would then apply the custom made sill foundation covering on top of the existing elevator sill system. The sill foundation covering would be attached to the existing elevator sill system through the use of adhesive tape or other bonding chemicals or methods. The cladding of the existing elevator sill system, which in this case functions as a sill foundation, with the sill foundation covering does not interfere with the existing elevator door system, thus providing seamless integration between the sill foundation covering and the pre-existing elevator sill system.

In another example, the existing elevator sill system requires routing so that the custom sill foundation covering can be integrated into the existing elevator door system. Once the required routing is completed, the sill foundation covering can be attached to the existing elevator sill system now functioning as the sill foundation in the same manner as above.

In yet another example, the sill foundation covering is manufactured by bending metal sheet, such as nickel, nickel-steel, nickel-silver, iron, stainless steel and the like into the proper configuration by a proprietary process of "v-grooving" wherein a groove is first cut in the metal sheet via a custom v-groove machine to create "v-channels" where the bends in the sheet will occur to create sharp, angled, non-rounded edges.

In other example, someone may wish to purchase a new elevator sill system. In this instance, the sill foundation device of the present invention is comprised of extruded aluminum, plastics or other manufactured materials such as PVC, acrylic, polycarbonate, ABS, polystyrene, epoxy, resin or epoxy resin that is formed into the necessary shape to fit the associated elevator and to accommodate the sill foundation covering. The combined sill foundation and sill foundation covering are of the proper dimensions and possess the proper grooves and tracks such that it can be integrated into the desired elevator door system. In this example, the integrated sill foundation covering and sill foundation of the present invention create an elevator sill system with identical external properties as more expensive currently existing elevator sills systems at a fraction of the cost.

One of skill in the art will appreciate that the above examples do not limit the manner in which the device of the instant invention may be constructed and/or implemented but are just examples of the flexibility and low-cost of using the device of the present invention over known alternatives.

Publications cited throughout this document are hereby incorporated by reference in their entirety. Although the various aspects of the invention have been illustrated above by reference to examples and preferred embodiments, it will be appreciated that the scope of the invention is defined not by the foregoing description but by the following claims properly construed under principles of patent law.

Each and every feature described herein, and each and every combination of two or more of such features, is included within the scope of the present invention provided that the features included in such a combination are not mutually exclusive.

What is claimed is:

1. An elevator sill assembly, comprising:

a first elevator sill foundation covering configured to cover a corresponding first elevator sill foundation; and a first elevator sill foundation covering adhesive member respectively corresponding to the first elevator sill foundation covering, and defining a one-piece construction comprising a longitudinal axis therealong, the first elevator sill foundation covering adhesive member being configured to conform to one or more portions of the first elevator sill foundation covering in response to the first elevator sill foundation covering adhesive member contacting the first elevator sill foundation covering member along the one or more portions thereof, each of the first elevator sill foundation covering and the first elevator sill foundation covering adhesive member defining the elevator sill assembly as a first elevator sill assembly configured to in an elevator door system comprising an elevator sill system comprising a second elevator sill assembly comprising an elevator sill foundation and a respectively corresponding second elevator sill foundation covering, match at least a shape of the first elevator sill assembly covering to the second elevator sill foundation covering, the matching being in response to an in situ measurement of the second elevator sill foundation covering defining dimensions of the first elevator sill foundation covering of the first elevator sill assembly, and rendering the first elevator sill foundation covering as a substantial duplicate of the second elevator sill foundation covering, and in which in response to the first elevator sill foundation covering adhesive member contacting the first elevator sill foundation covering and defining the first elevator sill assembly as a result of said contacting, the first elevator sill assembly is configured to be received by the second elevator sill assembly, on a topside of the second elevator sill foundation covering thereof, and to substantially duplicate operational characteristics of the second elevator sill assembly within the elevator door system.

2. The elevator sill assembly of claim 1, wherein:

respective contours of the first elevator sill foundation covering and the first elevator foundation covering adhesive member are configured to be substantially aligned with each other in response to contact therebetween.

3. The elevator sill assembly of claim 1, wherein:

the first elevator sill foundation covering comprises metal.

4. The elevator sill assembly of claim 3, wherein:

the first elevator sill foundation covering adhesive member comprises permanent, double-sided tape.

5. A method of preparing an elevator sill assembly according to claim 1 for installation in an elevator sill system, comprising:

measuring the second elevator sill assembly foundation covering according to claim 1;

providing the first elevator sill assembly foundation covering and the first elevator sill assembly foundation covering adhesive member according to claim 1 to each match the measuring of the second elevator sill assembly foundation covering;

adhering a first side of the first elevator sill assembly foundation covering adhesive member to an underside of the first elevator sill assembly foundation covering; and securing a second side of the first elevator sill assembly foundation covering adhesive member to the topside of the second elevator sill assembly foundation covering.

* * * * *